US007205878B2

(12) United States Patent
Lin et al.

(10) Patent No.: US 7,205,878 B2
(45) Date of Patent: Apr. 17, 2007

(54) OVER-CURRENT PROTECTION DEVICE AND MANUFACTURING METHOD THEREOF

(75) Inventors: Zack Lin, Sindian (TW); Ching Han Yu, Fonglin Township, Hualien County (TW)

(73) Assignee: Polytronics Technology Corporation, Hsinchu (TW)

( * ) Notice: Subject to any disclaimer, the term of this patent is extended or adjusted under 35 U.S.C. 154(b) by 333 days.

(21) Appl. No.: 10/978,856

(22) Filed: Nov. 1, 2004

(65) Prior Publication Data

US 2005/0094347 A1 May 5, 2005

(30) Foreign Application Priority Data

Nov. 5, 2003 (TW) ..... 92130914 A

(51) Int. Cl.
*H01H 85/11* (2006.01)
*H01C 7/13* (2006.01)

(52) U.S. Cl. ..... 337/167; 337/187; 338/22 R

(58) Field of Classification Search ..... 337/167, 337/186, 187; 439/620.08; 392/502; 338/22 R
See application file for complete search history.

(56) References Cited

U.S. PATENT DOCUMENTS 4,780,598 A * 10/1988 Fahey et al. ..... 219/511
4,801,784 A * 1/1989 Jensen et al. ..... 219/548
5,303,115 A * 4/1994 Nayar et al. ..... 361/106
5,307,519 A * 4/1994 Mehta et al. ..... 455/343.1
5,313,184 A * 5/1994 Greuter et al. ..... 338/21
5,414,403 A * 5/1995 Greuter et al. ..... 338/22 R
5,436,609 A * 7/1995 Chan et al. ..... 338/22 R
5,488,348 A * 1/1996 Asida et al. ..... 338/22 R
5,688,424 A * 11/1997 Asida ..... 219/531
5,776,371 A * 7/1998 Parker ..... 252/502
5,852,397 A * 12/1998 Chan et al. ..... 338/22 R
5,907,272 A * 5/1999 McGuire ..... 338/22 R
6,489,879 B1 * 12/2002 Singh et al. ..... 337/167
6,651,315 B1 * 11/2003 Graves et al. ..... 29/621
6,661,633 B1 * 12/2003 Furuta et al. ..... 361/103
6,806,806 B2 * 10/2004 Anthony ..... 337/199
6,854,176 B2 * 2/2005 Hetherton et al. ..... 29/623
2002/0130757 A1 * 9/2002 Huang et al. ..... 338/22 R

FOREIGN PATENT DOCUMENTS

JP 06267709 A * 9/1994

* cited by examiner

*Primary Examiner*—Anatoly Vortman
(74) *Attorney, Agent, or Firm*—Seyfarth Shaw LLP

(57) ABSTRACT

An over-current protection device comprises at least one PTC component, at least one thermal dissipation layer, at least one adhesive layer and at least two isolation layers, wherein the PTC component is formed by interposing a PTC material between two electrode layers. The at least one adhesive layer as a thermal conductive medium is interposed between the PTC component and at least one thermal dissipation layer to combine them. The at least two isolation layers separate the thermal dissipation layer, adhesive layer and electrode layers into two electrical independent portions.

20 Claims, 10 Drawing Sheets

OVER-CURRENT PROTECTION DEVICE AND MANUFACTURING METHOD THEREOF

BACKGROUND OF THE INVENTION (A) Field of the Invention

The present invention is related to an over-current protection device and manufacturing method thereof, more specifically, to an over-current protection device with high thermal dissipation and manufacturing method thereof.

(B) Description of the Related Art

For the present broad application of portable electronic products, such as mobile phone, notebook, portable camera, and personal digital assistant (PDA), the use of over-current protection devices to prevent the short circuit caused by an over-current or over-heating effect in a secondary battery or circuit device is becoming more and more important.

The resistance of a positive temperature coefficient (PTC) conductive material is sensitive to temperature variation, and can be kept extremely low at normal operation due to its low sensitivity to temperature variation so that the circuit can operate normally. However, if an over-current or an over-temperature event occurs, the resistance will immediately increase to a high resistance state (e.g., above $10^4$ ohm.) Therefore, the over-current will be reversely eliminated and the objective to protect the circuit device can be achieved.

As shown in FIG. 1, a conventional over-current protection device 10 comprises a PTC material layer 101, two electrode layers 102, two isolation layers 103, two conductive bars 104 and two soldering electrode layers 105. The soldering electrode layers 105 are overlaid on the electrode layers 102 which are overlaid on the upper and lower surfaces of the PTC material layer 101. The two electrode layers 102 and two soldering electrode layers 105, over and under the PTC material layer 101, are electrically connected to each other by means of the conductive bars 104 through the PTC material layer 101 and two electrode layers 102. The isolation layer 103 separates the electrode layer 102 into right and left portions which are isolated from each other. Therefore, the over-current protection device 10 has two right and left electrical terminals, and leads (not shown) are employed to separately connect them with a circuit or a device which needs to be protected.

The current trend is towards miniaturizing electrical apparatuses, hence the thermal dissipation of the electrical device becomes more important for consideration to design parameters. If heat energy cannot be effectively dissipated, the lifetime and reliability of the over-current protection device are degraded.

SUMMARY OF THE INVENTION

The objective of the present invention is to provide an over-current protection device and manufacturing method thereof for fast dissipating heat generating from the over-current protection device so as to be suitable for an electrical apparatus gradually towards a miniaturized volume.

To achieve the above-mentioned objective, an over-current protection device has been developed. The over-current protection device comprises at least one PTC component, at least one thermal dissipation layer, at least one adhesive layer and at least two isolation layers, wherein the PTC component is formed by interposing a PTC material between two electrode layers. The at least one adhesive layer as a thermal conductive medium is interposed between the PTC component and at least one thermal dissipation layer to combine them. The at least two isolation layers separate the thermal dissipation layer, adhesive layer and electrode layers into two electrical independent portions.

The over-current protection device further comprises at least one conductive bar which electrically connects the two electrode layers. Furthermore, two soldering electrode layers are overlaid on the surfaces of the electrode layers to avoid the occurrence of oxidization.

The thermal dissipation layer acts as a heat sink to fast dissipate the heat generating from the PTC component so as to upgrade the life, reliability and application of the over-current protection device.

The manufacturing method of the over-current protection device contains the following steps: providing at least one PTC component, which is a PTC material stacked between two electrode layers in Step (a); forming an adhesive layer on the surface of the PTC component in Step (b); forming a thermal dissipation layer on the surface of the adhesive layer in Step (c); and forming at least two isolation layer to separate the thermal dissipation layer, adhesive layer and electrode layers into two electrical independent portions in Step (d).

BRIEF DESCRIPTION OF THE DRAWINGS

FIG. 2(*b*) illustrates a cross-section diagram along the line 1—1 in FIG. 2(*a*);

DETAILED DESCRIPTION OF THE INVENTION

Figure 1:
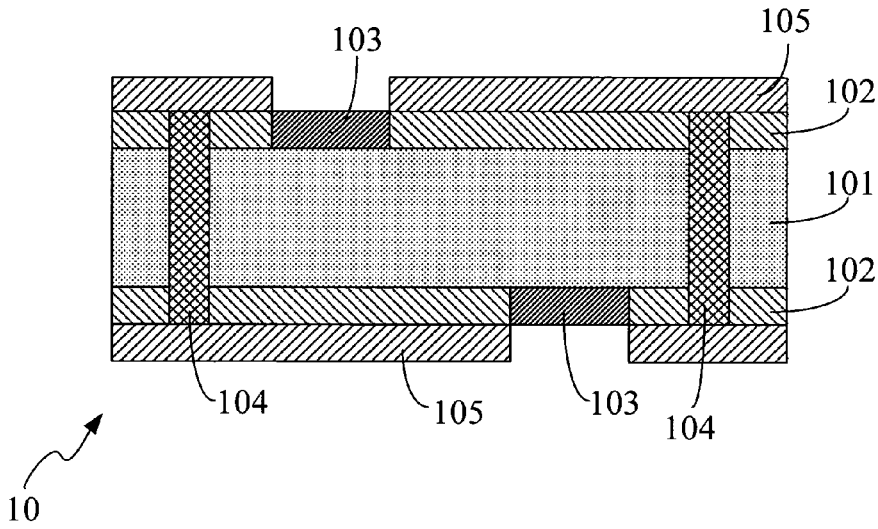
FIG. 1 (Background Art)
FIG. 1 illustrates a known over-current protection device.
Figure 2A:
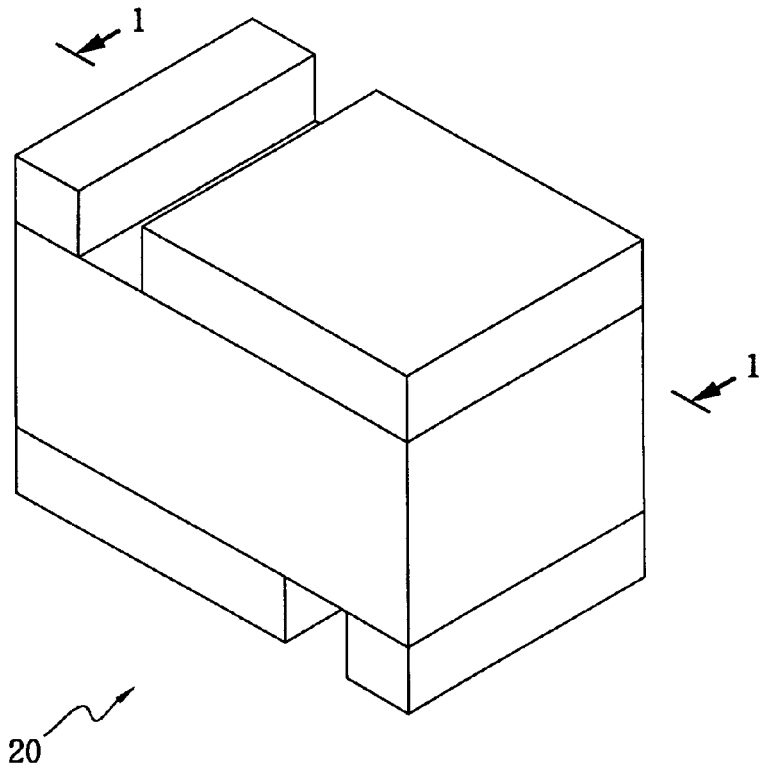
FIG. 2(*a*) illustrates an over-current protection device in accordance with the first embodiment of the present invention.
Figure 2B:
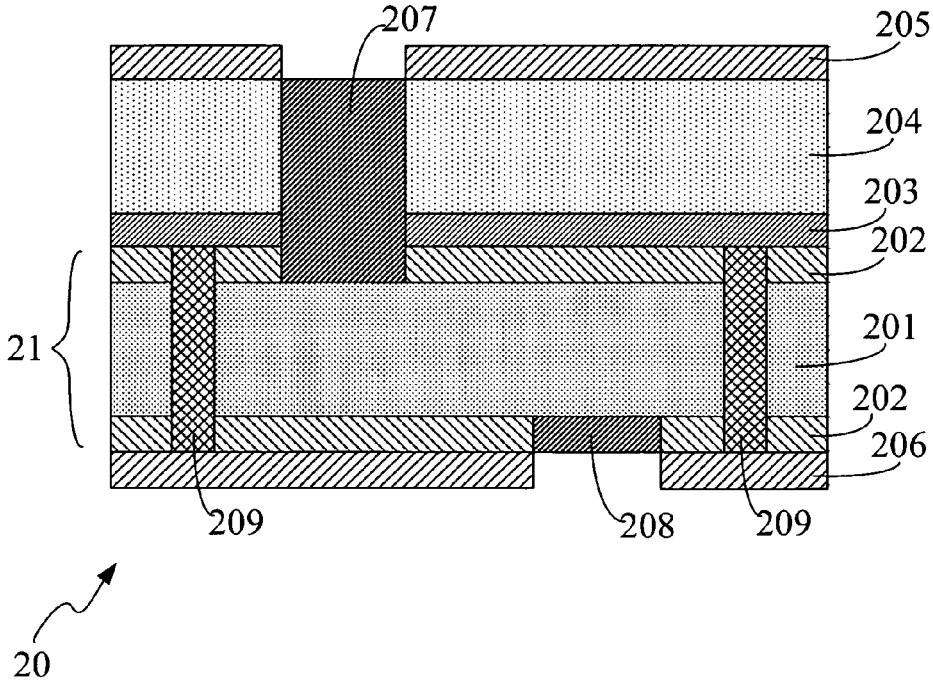

Referring to FIGS. 2(*a*)–2(*b*), FIG. 2(*a*) illustrates a perspective diagram of an over-current protection device in accordance with the first embodiment of the present invention, and FIG. 2(*b*) illustrates a cross-section diagram along the line 1—1 in FIG. 2(*a*). An over-current protection device comprises a PTC material layer 201, two electrode layers 202, an adhesive layer 203, a heat dissipation layer 204, two isolation layers 207 and 208, two conductive bars 209 and two soldering electrode layers 205 and 206. The PTC material layer 201 is sandwiched between the two electrode layers 202 to form a PTC component 21. The PTC material layer 201 is made from a polymeric positive temperature coefficient (PPTC) material. The adhesive layer 203, acting as a thermal conductive medium and a connecter, is interposed between the PTC component 21 and heat dissipation layer 204. The adhesive layer 203 is made from an electrical conductive material or an electrical non-conductive material such as conductive silver adhesive, conductive copper adhesive, non-conductive resin and non-conductive epoxy plastics. The heat dissipation layer 204 is overlaid on the surface of the adhesive layer 203 and is made by aluminum, copper, or their alloy with high heat dissipation. If over-current or over-temperature occurs, the heat generating from the PTC component 21 is conducted to the heat dissipation layer 204 by the adhesive layer 203 for fast dissipation. The isolation layer 207 respectively separates the heat dissipation layer 204, adhesive layer 203 and electrode layer 202 over the PTC material layer 201 into two electrical independent portions. The isolation layer 208 separates the electrode layer 202 beneath the PTC material layer 201 into two electrical independent positions. The space of the conductive bar 209 is previously formed by means of mechanical drilling or laser drilling, and then electroplating copper, electroplating silver or conductive paste (such as copper paste and silver paste) is deposited or filled into the space. The soldering electrode layer 205 covers the heat dissipation layer 204, whereas the soldering electrode layer 206 covers the electrode layer 202 beneath the PTC material layer 201. The soldering electrode layers 205 and 206 act as contacts connected to a circuit or a device, which needs to be protected, by wires, and are made by tin, lead or their alloy against oxidization so as to protect the heat dissipation layer 204 and electrode layer 202 from corrosion.

In this embodiment, because the adhesive layer 203 is made by a non-conductive material, the soldering electrode layer 205 cannot be electrically connected to the PTC component 21. In this regard, wires (not shown) are only soldered with the soldering electrode layer 206, hence the flexibility of manufacture is reduced. However, if the adhesive layer 203 is made by a electrical conductive material and two wires (not shown) are respectively connected to the right portion and left portion of the soldering electrode layer 206, the two wires are also electrically connected to the PTC component 21 in series so as to achieve the predetermined protection effect no matter whether the left one of the conductive bars 209 exists. Therefore, the left conductive bar 209 can be neglected.

The thermal conductivity, heat capacity and electrical conductivity of aluminum and copper are listed in Table 1 as follows. Referring to Table 1, the heat dissipation and electrical conductivity of aluminum and copper are superior to those of other metal. Furthermore, the cost of them is less expensive than that of silver. Therefore, the heat dissipation layer 204 made by aluminum, copper and their alloy (aluminum-copper alloy) can fast dissipate the heat generating from the PTC component 21.

TABLE 1

| | Aluminum | Copper |
|---|---|---|
| Thermal conductivity (siemens/m) | $0.377 * 10^6$ | $0.596 * 10^6$ |
| heat capacity (J/Kg ° C.) | 910 | 390 |
| electrical conductivity (W/m ° C.) | 160 | 200 |

The perspective diagrams of over-current protection devices in accordance with the other embodiments of the present invention are similar to FIG. 2(*a*). The differences between them are the variations in the thicknesses of the layers. Therefore, the succeeding embodiments only illustrate their cross-section diagrams in replacement of the perspective diagrams.

Figure 3:
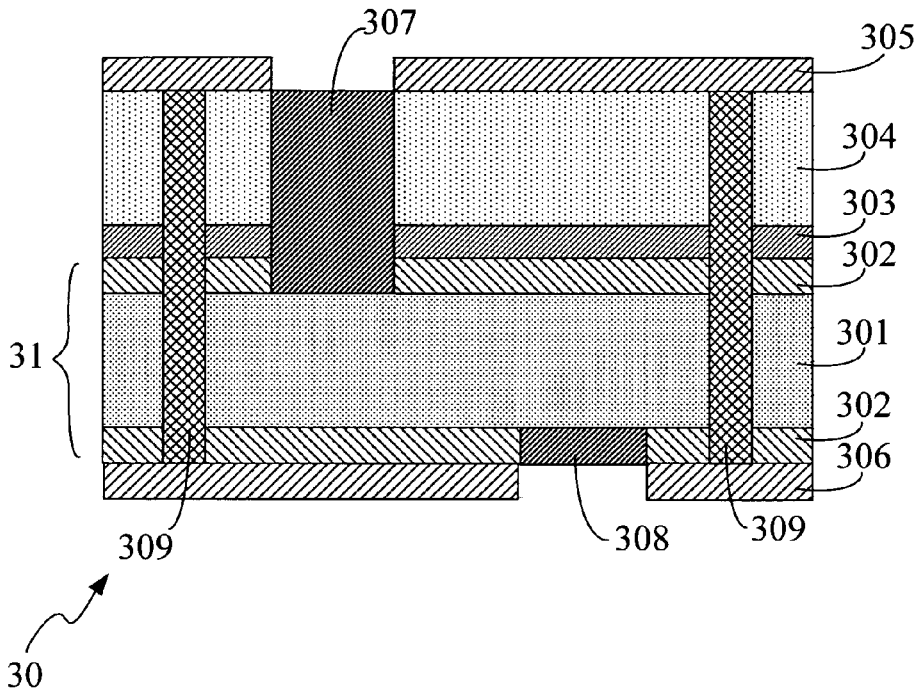
FIG. 3 illustrates an over-current protection device in accordance with the second embodiment of the present invention.

FIG. 3 illustrates an over-current protection device in accordance with the second embodiment of the present invention. An over-current protection device 30 comprises a PTC material 301, two electrode layers 302, a adhesive layer 303, a heat dissipation layer 304, two isolation layers 307 and 308, two conductive bars 309 and two soldering electrode layers 305 and 306. A PTC component 31 is formed by that the PTC material 301 is stacked between the two electrode layers 302. In comparison with the over-current protection device 20, the conductive bars 309 of the over-current protection device 30 in the current embodiment extend from the upper soldering electrode layer 305 to the lower soldering electrode layer 306. Consequently, even though the adhesive layer 303 is made by a non-conductive material, the PTC component 31 can still be connected to the soldering electrode layer 305. Furthermore, regarding the manufacturing process, after the adhesive layer 303 and heat dissipation layer 304 are stacked on the PTC component 31, the process of the conductive bar 309 starts from drilling. Therefore, the manufacturing process has much flexibility.

Figure 4:
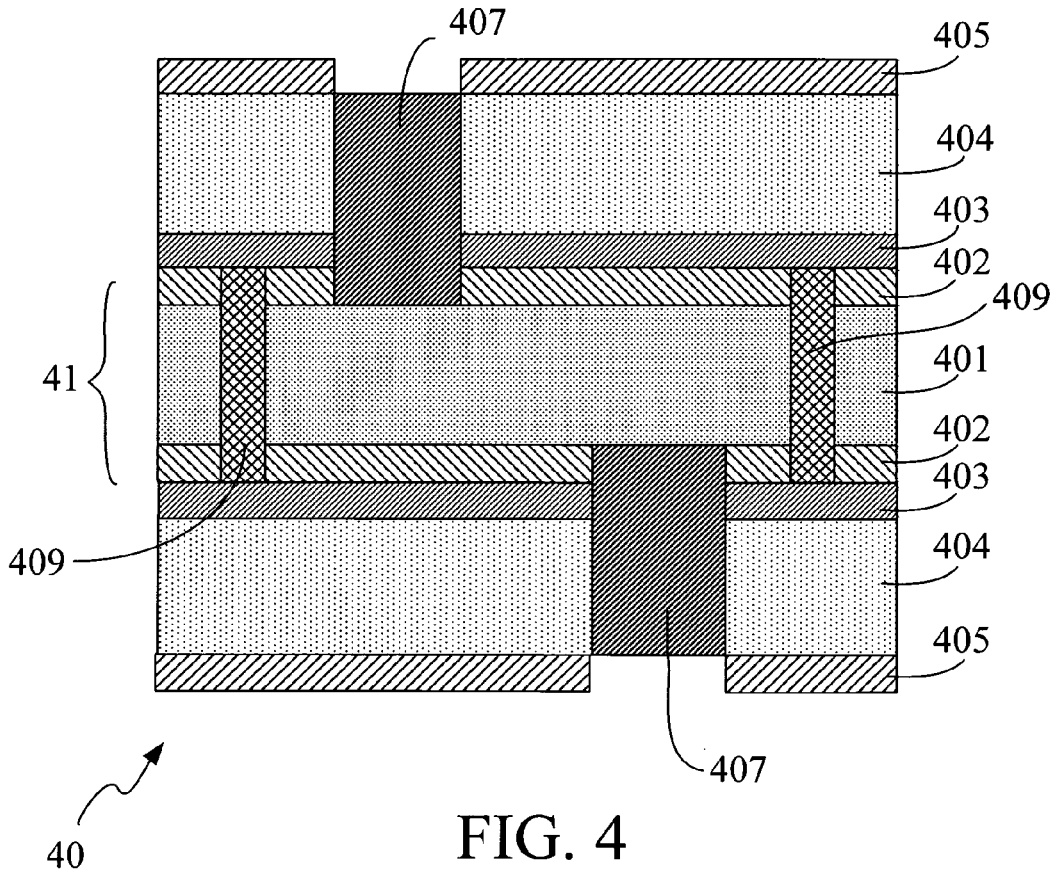
FIG. 4 illustrates an over-current protection device in accordance with the third embodiment of the present invention.

FIG. 4 illustrates an over-current protection device in accordance with the third embodiment of the present invention, wherein the over-current protection device has two heat dissipation layers. The over-current protection device 40 comprises a PTC material 401, two electrode layers 402, two adhesive layers 403, two heat dissipation layers 404, two isolation layers 407, two conductive bars 409 and two soldering electrode layers 405. A PTC component 41 is formed by that the PTC material 401 is stacked between the two electrode layers 402. The two adhesive layers 403, two heat dissipation layers 404, and two soldering electrode layers 405 are sequentially stacked on the upper surface and lower surface of the PTC component 41. In comparison with the over-current protection device 20 in the first embodiment, the over-current protection device 40 of the current embodiment further comprises the heat dissipation layer 404 placed at the side of the PTC component 41, hence the two heat dissipation layers 404 can fast conduct and dissipate the heat generating from the PTC component 41 through its two sides.

Figure 5:
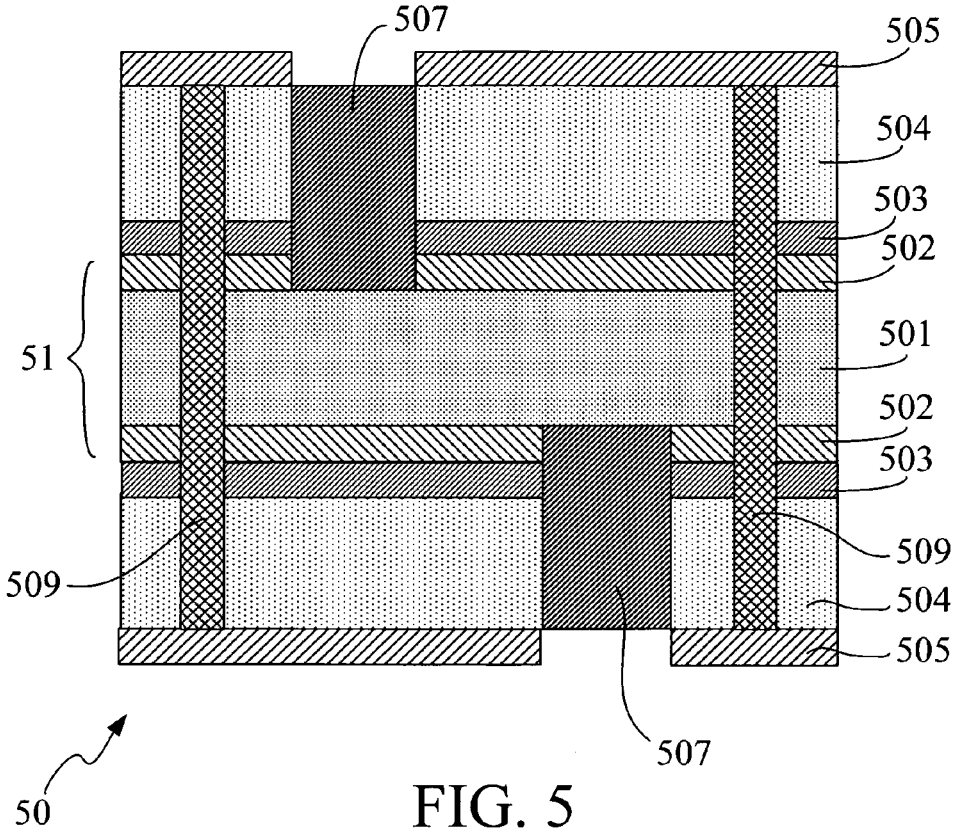
FIG. 5 illustrates an over-current protection device in accordance with the forth embodiment of the present invention.
Figure 6A:
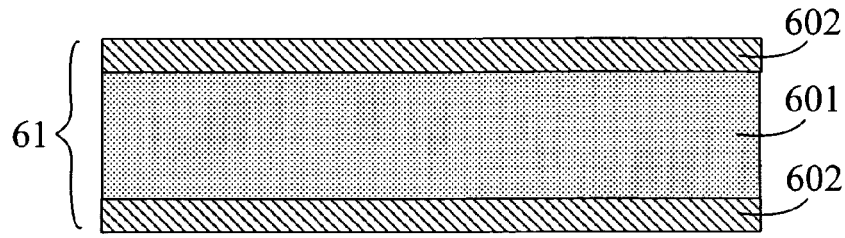
FIGS. 6(*a*)–6(*f*) illustrate a manufacturing method of the over-current protection device in accordance with the fifth embodiment of the present invention.
Figure 6B:
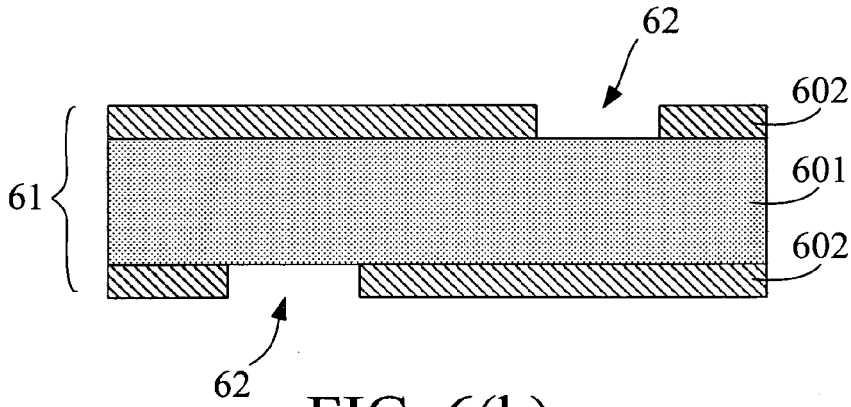
Figure 6C:
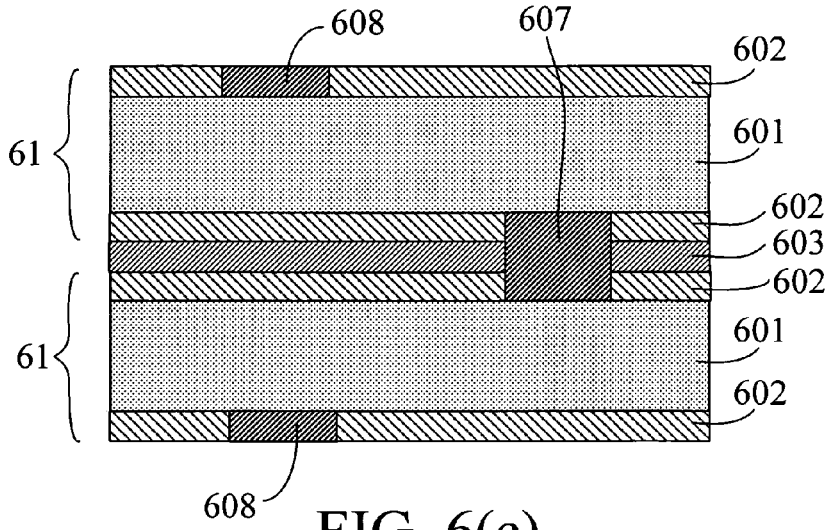
Figure 6D:
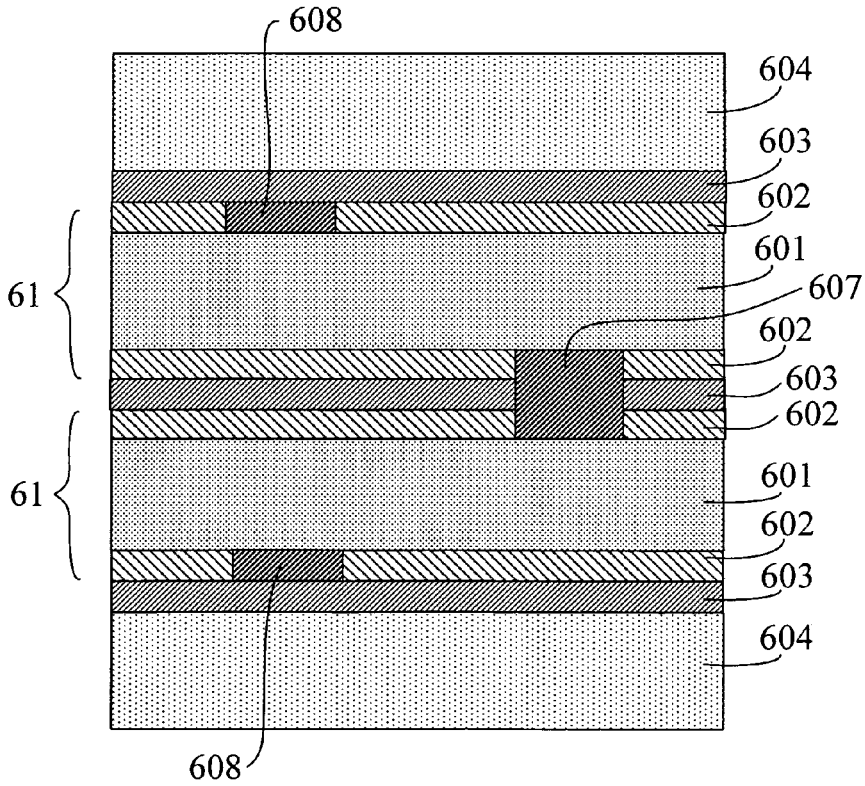
Figure 6E:
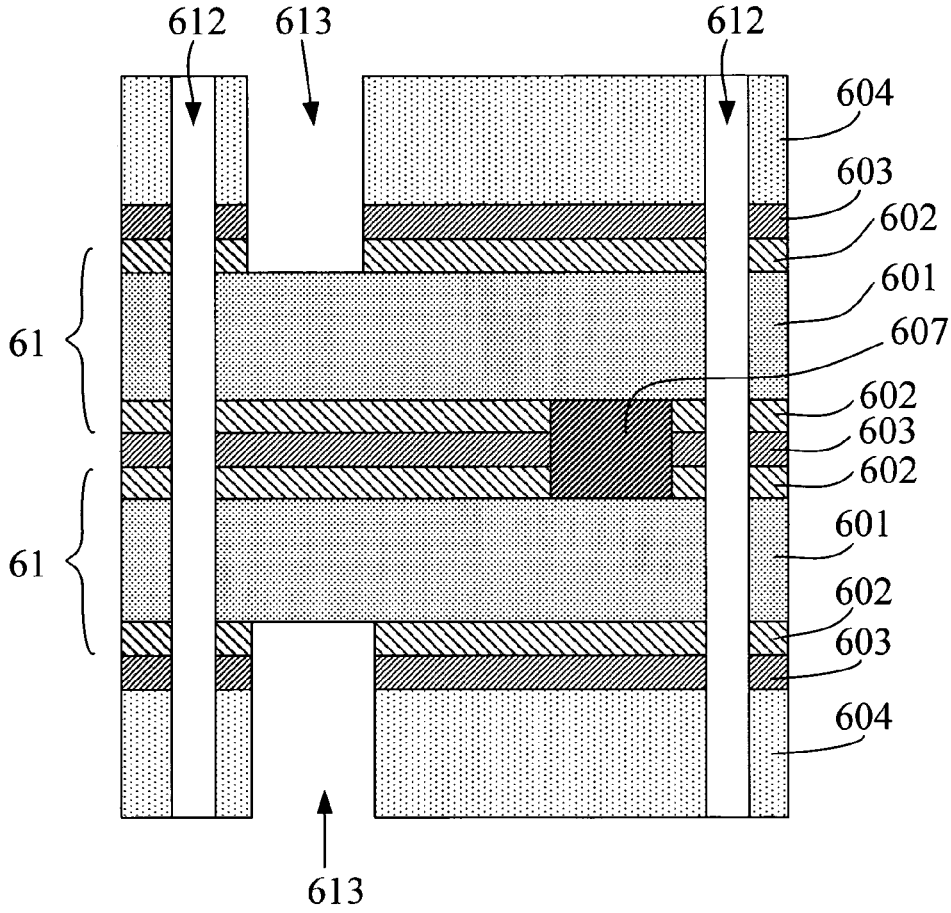
Figure 6F:
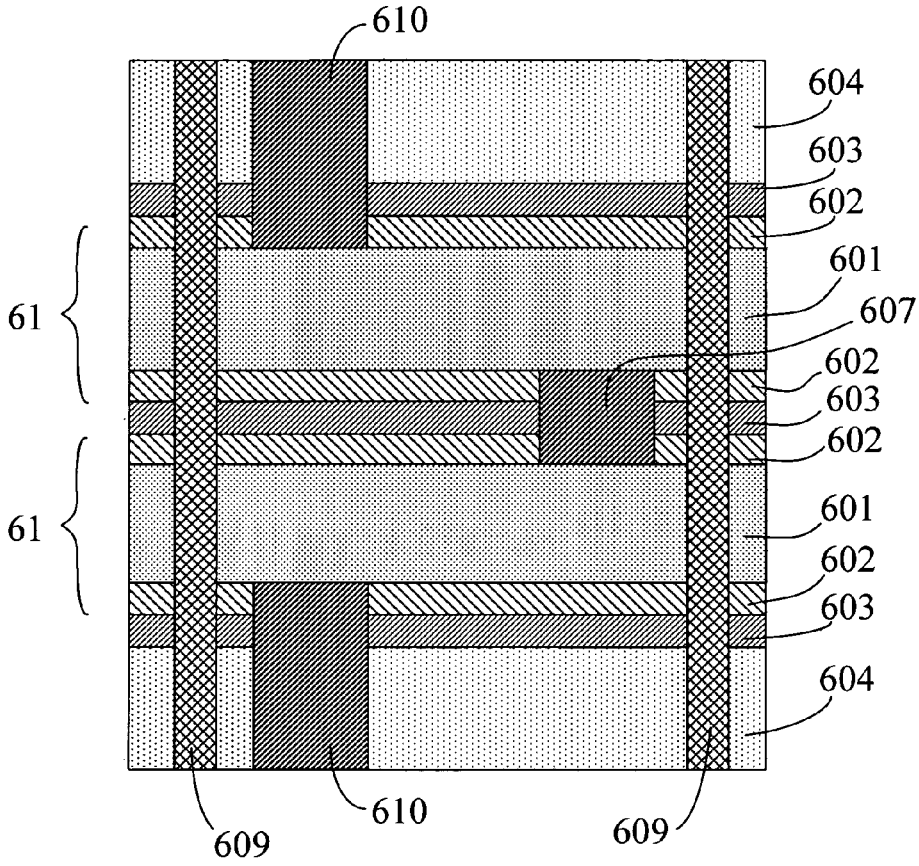

FIG. 5 illustrates an over-current protection device in accordance with the forth embodiment of the present invention. The over-current protection device 50 comprises a PTC material 501, two electrode layers 502, two adhesive layers 503, two heat dissipation layers 504, two isolation layers 507, two conductive bars 509 and two soldering electrode layers 505. A PTC component 51 is formed by that the PTC material 501 is stacked between the two electrode layers 502. In comparison with the over-current protection device 40 in the third embodiment, the conductive bars 509 of the over-current protection device 50 in the current embodiment extends from the upper soldering electrode layer 505 to the lower soldering electrode layer 506. The advantages of the current embodiment are similar to that of the second embodiment, and are not mentioned again.

In addition, the over-current protection device of the present invention also comprises a plurality of PTC components in parallel connection with each other, hence the resistance is reduced. An over-current protection device that has two PTC components is introduced as follows. The manufacturing process of the present invention is also illustrated in the following embodiment.

FIGS. 6(*a*)–6(*g*) illustrate a manufacturing method of the over-current protection device in accordance with the fifth embodiment of the present invention. Referring to FIG. 6(*a*), two PTC components 61 are first provided, and each of the PTC components 61 is a PTC material 601 stacked between the two electrode layers 602. Afterward, openings 62 are formed on the PTC material 601 by etching and so on, as shown in FIG. 6(*b*). For simplifying the diagrams, FIG. 6(*a*)–6(*b*) only show one of the two PTC components 61.

Referring to FIG. 6(*c*), the two PTC components 61 are stacked on each other by an adhesive layer 603, and the openings 62 are filled with a nonconductive material such as a solder-mask material to form isolation layers 607 and 608. Referring to 6(*d*), two adhesive layers 603 are employed so as to combine two heat dissipation layers 604 with the exposed electrode layers 602. As shown in FIG. 6(*e*), two through holes 602 are formed, after the two PTC components 61, two heat dissipation layers 604 and adhesive layers 603 are drilled by mechanical drilling or laser drilling. Furthermore, two openings 613 are formed by slitting the heat dissipation layers 604, adhesive layers 603 and isolation layers 608 into two independent portions by means of etching, laser, cutting and milling. Referring to 6(*f*), two conductive bars 609 are formed in the openings 612 by electroplating and conductive paste filling and so on, and the openings 613 are filled with a solder mask material to have two isolation layers 610. Referring to FIG. 6(*g*), soldering electrode layers are finally overlaid on the heat dissipation layers 604.

In fact, the over-current protection devices disclosed by the aforesaid first to forth embodiments also employ the same process the fifth embodiment discloses. There are some differences between their steps in sequence, for example the manufacturing steps of the conductive bars and heat dissipation layers are in reverse order.

In addition, the aforesaid over-current protection devices all comprise two conductive bars. However, the conductive bars can be neglected if the adhesive layers are replaced with a conductive material and external wires are connected to the soldering electrode layers. The wires and the PTC component are in electrical series connection between them, so the protection effect acts on.

Though a person skilled in the art of this field can change the sequence of the aforesaid manufacturing steps according to the various structures of the over-current protection devices, if the application employs the same theory as the present invention, it does not depart from the scope of the present invention.

The soldering electrode layers are not the essential elements for the over-current protection device of the present invention. If the over-current protection device exists in vacuum circumstance or free-of-oxygen circumstance, the soldering electrode layers can be neglected.

The above-described embodiments of the present invention are intended to be illustrative only. Numerous alternative embodiments may be devised by those skilled in the art without departing from the scope of the following claims.

What is claimed is:

1. An over-current protection device, comprising:

at least one PTC (positive temperature coefficient) component including a PTC material layer sandwiched in between two electrode layers;

at least one heat dissipation layer;

at least one adhesive layer for combining the PTC component with the heat dissipation layer and acting as a thermal conductive medium therebetween; and at least two isolation layers for separating respectively the heat dissipation layer, adhesive layer and electrode layers into two electrical independent portions.

2. The over-current protection device of claim 1, wherein the PTC material layer is made of a polymeric PTC material.

3. The over-current protection device of claim 1, wherein the material of the heat dissipation layer is selected from the group consisting of aluminum, copper and alloy thereof.

4. The over-current protection device of claim 1, wherein the adhesive layer is made of silver paste or copper paste.

5. The over-current protection device of claim 1, wherein the adhesive layer is made of resin or epoxy plastics.

6. The over-current protection device of claim 1, wherein the isolation layer is made of a solder mask material.

7. The over-current protection device of claim 1, further comprising at least one conductive bar electrically connecting the two electrode layers.

8. The over-current protection device of claim 7, wherein the conductive bar is made of silver paste or copper paste.

9. The over-current protection device of claim 7, wherein the conductive bar is made of electroplating copper or electroplating silver.

10. The over-current protection device of claim 1, further comprising two soldering electrode layers overlaid on the electrode layers or the heat dissipation layer.

11. The over-current protection device of claim 10, wherein the material of the soldering electrode layers is selected from the group consisting of tin, lead and alloy thereof.

12. The over-current protection device of claim 7, further comprising two soldering electrode layers overlaid on the electrode layers or the heat dissipation layer, wherein the conductive bar electrically connects the two soldering electrode layers.

13. A manufacturing method for an over-current protection device, comprising the steps of:

providing at least one PTC component including a PTC material sandwiched in between two electrode layers;

forming an adhesive layer on the PTC component;

forming at least one heat dissipation layer on the adhesive layer; and forming at least two isolation layers to separate respectively the heat dissipation layer, adhesive layer and electrode layers into two electrically independent portions.

14. The manufacturing method for an over-current protection device of claim 13, further comprising a step of forming at least one conductive bar to connect the two electrode layers.

15. The manufacturing method for an over-current protection device of claim 13, further comprising a step of forming two soldering electrode layers on the heat dissipation layer or the electrode layers.

16. The manufacturing method for an over-current protection device of claim 14, further comprising forming two soldering electrode layers on the heat dissipation layer or the electrode layers, wherein the conductive bar connects the two soldering electrode layers.

17. The manufacturing method for an over-current protection device of claim 14, wherein the conductive bar is manufactured by one of the methods including electroplating and filling of conductive paste.

18. The manufacturing method for an over-current protection device of claim 13, wherein the isolation layers are manufactured by one of the methods including etching, laser cutting, mechanical cutting and milling to first form opens, and filling the openings with a non-conductive material.

19. The manufacturing method for an over-current protection device of claim 18, wherein the non-conductive material is a solder mask material.

20. The manufacturing method for an over-current protection device of claim 13, wherein the material of the heat dissipation layer is selected from the group consisting of aluminum, copper or alloy thereof.

* * * * *